US008147046B2

(12) United States Patent
Yamashita

(10) Patent No.: US 8,147,046 B2
(45) Date of Patent: Apr. 3, 2012

(54) REFILLABLE INK CARTRIDGE AND PROTECTION MEMBER THEREFOR

(75) Inventor: Hiroyuki Yamashita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 522 days.

(21) Appl. No.: 12/375,950

(22) PCT Filed: Apr. 17, 2008

(86) PCT No.: PCT/JP2008/057882

§ 371 (c)(1),
(2), (4) Date: Feb. 2, 2009

(87) PCT Pub. No.: WO2008/155946

PCT Pub. Date: Dec. 24, 2008

(65) Prior Publication Data

US 2009/0262171 A1 Oct. 22, 2009

(30) Foreign Application Priority Data

Jun. 18, 2007 (JP) ..... 2007-160705

(51) Int. Cl.
*B41J 2/175* (2006.01)

(52) U.S. Cl. ..... 347/86

(58) Field of Classification Search ..... 347/86
See application file for complete search history.

(56) References Cited

U.S. PATENT DOCUMENTS

| | | | | |
|---|---|---|---|---|
| 5,790,157 | A | 8/1998 | Higuma et al. | |
| 7,287,843 | B2 * | 10/2007 | Muranaka et al. | 347/86 |
| 7,377,627 | B2 * | 5/2008 | Muranaka et al. | 347/86 |
| 2003/0122909 | A1 | 7/2003 | Ogura et al. | |
| 2004/0263587 | A1 | 12/2004 | Tsuyuki et al. | |
| 2005/0248638 | A1 | 11/2005 | Suzuki et al. | |
| 2006/0038863 | A1 | 2/2006 | Piccinino, Jr. et al. | |
| 2007/0070136 | A1 | 3/2007 | Hattori et al. | |

FOREIGN PATENT DOCUMENTS

| | | |
|---|---|---|
| EP | 0640484 A2 | 3/1995 |
| EP | 1570995 A1 | 9/2005 |
| JP | 57-131565 | 8/1982 |
| JP | 10-6523 | 1/1998 |
| JP | 2001-180004 | 7/2001 |
| JP | 2003-305865 | 10/2003 |
| JP | 2004-25713 | 1/2004 |

(Continued)

OTHER PUBLICATIONS

Dec. 11, 2009 European search report in connection with counterpart European application No. 08 74 0809 2.

(Continued)

*Primary Examiner* — Matthew Luu
*Assistant Examiner* — Lisa M Solomon
(74) *Attorney, Agent, or Firm* — Cooper & Dunham LLP

(57) ABSTRACT

In a refillable ink cartridge having an ink supply opening portion that is hermetically sealed with a sealing member, leakage of ink out of the cartridge due to a decrease in the sealing property of the sealing member is prevented. The sealing member, which is elastically deformable, is penetrated by a needle-shaped member when refilling the cartridge with ink via the ink supply opening portion. The ink supply opening portion is covered with a protection member including a projecting portion for hermetically sealing the ink supply opening portion outside the sealing member.

9 Claims, 9 Drawing Sheets

FOREIGN PATENT DOCUMENTS

| | | |
|---|---|---|
| JP | 2004-284094 | 10/2004 |
| JP | 2004-358802 | 12/2004 |
| JP | 3639836 | 1/2005 |
| JP | 3667750 | 4/2005 |
| JP | 2006-69030 | 3/2006 |
| JP | 3799967 | 5/2006 |

OTHER PUBLICATIONS

Jul. 27, 2010 Japanese official action in connection with counterpart Japanese patent application.
Jun. 13, 2010 Chinese official action in connection with counterpart Chinese patent application.

* cited by examiner

REFILLABLE INK CARTRIDGE AND PROTECTION MEMBER THEREFOR

TECHNICAL FIELD

This disclosure relates to a refillable ink cartridge and a protection member for a refillable ink cartridge.

BACKGROUND ART

In some image forming apparatuses such as printers, facsimile machines, copiers, and multifunction peripherals, image formation (involving recording, printing, transfer, etc., of an image) is carried out using a liquid discharge device. Such a liquid discharge device typically includes a write head configured to discharge a liquid droplet onto a medium (such as a recorded/recording medium, a transfer material, and a recording paper; the material of the medium is not particularly limited) as the medium is transported.

The term "image forming apparatus" herein refers to a device for forming an image on a medium of various materials, such as paper, thread, fiber, fabrics, leather, metals, plastics, glass, wood, and ceramics, by discharging a liquid onto such a medium. The term "image formation" herein refers to the formation of not just some image with an intended meaning, such as a character or a diagram, but it also refers to the process of providing a medium with some image without any intended meaning, such as a random pattern. The term "ink" herein does not refer to any specific ink in a narrow sense but it generally refers to liquids that can be used for image formation. The term "liquid discharge device" herein refers to a device for discharging a liquid out of a liquid discharge head.

In an image forming apparatus fitted with such a liquid discharge device, an ink cartridge containing ink for image formation may be used. The ink cartridge is often discarded after running out of the ink. However, this leads to an increase in running cost and runs counter to the effective utilization of resources. Thus, refillable ink cartridges have been proposed and are widely known, which can be refilled with ink.

In one example of such a refillable ink cartridge, Japanese Patent No. 3799967, a used ink cartridge is refilled with ink and then its ink supply opening portion is affixed with a sealing tape. In another example, Japanese Patent No. 3639836, the ink cartridge has an ink refill opening to which a sealing member is attached in advance so that the refill opening can be sealed with the sealing member. In yet another example, Japanese Patent No. 3667750, an ink inlet is capped and further an adhesive-coated aluminum tape is affixed onto the cap, where the ends of the tape are bent onto each side of the cartridge. Covering an ink supply opening portion of a used ink cartridge with a sealing member for purposes other than refilling is conventional (see Japanese Laid-Open Patent Application No. 10-006523).

In these refillable ink cartridges, the ink supply opening portion is sealed after a refill using the various sealing members mentioned above because the supply opening of the original ink cartridge is left open after use. However, the sealing property of the sealing member may be degraded, or it may be insufficient when the ink is of quick-drying type.

To overcome these problems, an ink cartridge is proposed (Japanese Laid-Open Patent Application No. 2004-284094) in which an ink bag fitted with a retaining member is housed in a casing, wherein the ink bag has an ink supply opening portion (ink discharge opening). The ink supply opening portion is sealed with a resilient sealing member, which is retained by a cap member.

In this ink cartridge, the sealing member at the ink supply opening portion is pierced by a hollow needle-shaped member as part of an image forming apparatus, whereby the inside of the ink bag and the apparatus are communicated to allow the supply of ink. When the ink cartridge is detached from the apparatus main body, the sealing of the ink supply opening portion is maintained by the resilient force of the sealing member.

Such an ink cartridge can be refilled with ink by piercing the sealing member at the ink supply opening portion with a filling device such as a syringe, thus obtaining a refilled ink cartridge.

In this case, although the ink supply opening portion is sealed with the sealing member upon refill, the sealing member may be damaged by the needle-shaped member as it pierces the sealing member during a refill operation. If such a damage is present, the sealing property of the sealing member may decrease and become insufficient, resulting in the leakage of the ink through the pierced opening formed in the sealing member during transport or storage.

BRIEF SUMMARY

In an aspect of this disclosure, there is provided an approach to prevent the leakage of ink from an ink cartridge in the event that a sealing member of the ink cartridge deteriorates to such an extent that the ink can penetrate the sealing member.

In another aspect, there is provided a refillable ink cartridge containing ink that is supplied to a liquid discharge device that discharges a droplet of the ink. The refillable ink cartridge comprises an ink supply opening portion that is hermetically sealed with an elastically deformable sealing member. The sealing member is configured to be penetrated by a needle-shaped member in order to allow the refillable ink cartridge to be refilled with ink via the ink supply opening portion. The refillable ink cartridge further comprises a protection member including a sealing portion configured to hermetically seal the ink supply opening portion outside the sealing member.

The sealing portion of the protection member may, in an exemplary embodiment, include a projecting portion formed on an inner side of the protection member, the projecting portion contacting an outer surface of the ink supply opening portion to hermetically seal the ink supply opening portion. The sealing portion of the protection member may include a tight-contact portion that is tightly contacted with an outer surface of the sealing member of the ink supply opening portion. The sealing portion of the protection member may include an adhesive portion that adheres to an outer surface of the sealing member of the ink supply opening portion. The protection member may include a locking portion configured to be locked on the ink supply opening portion. The protection member may be fitted such that the sealing portion is compressed.

In yet another aspect, there is provided a protection member for sealing a refillable ink cartridge containing ink that is supplied to a liquid discharge device that discharges a droplet of the ink. The refillable ink cartridge comprises an ink supply opening portion that is hermetically sealed with an elastically deformable sealing member. The sealing member is configured to be penetrated by a needle-shaped member in order to allow the refillable ink cartridge to be refilled with ink via the ink supply opening portion. The protection member comprises a sealing portion configured to be disposed outside the sealing member of the ink supply opening portion to hermetically seal the ink supply opening portion.

Thus, the ink in the refillable ink cartridge can be prevented from leaking outside when the sealing member loses its sealing property to such a degree that the ink can penetrate the sealing member.

BRIEF DESCRIPTION OF THE DRAWINGS

These and other objects, features and advantages of the invention will be apparent to those skilled in the art from the following detailed description of the invention, when read in conjunction with the accompanying drawings in which.

BEST MODE OF CARRYING OUT THE INVENTION

In the following, the present invention is described by way of embodiments with reference made to the drawings. First, a refillable ink cartridge according to a first embodiment of the invention is described with reference to FIGS. 1 through 6.

Figure 1:
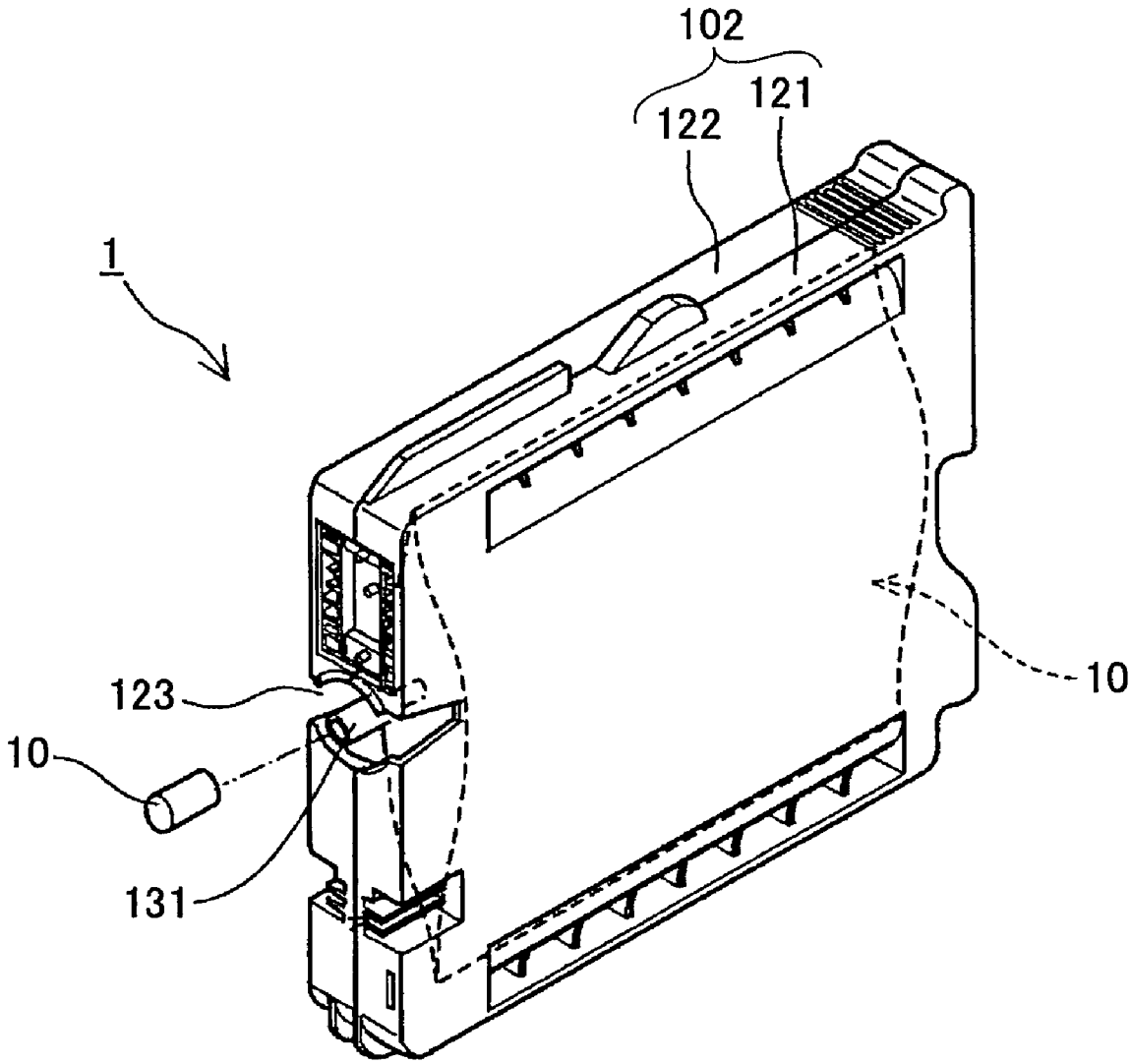
FIG. 1 is a perspective view of a refillable ink cartridge according to a first embodiment of the invention.
Figure 2:
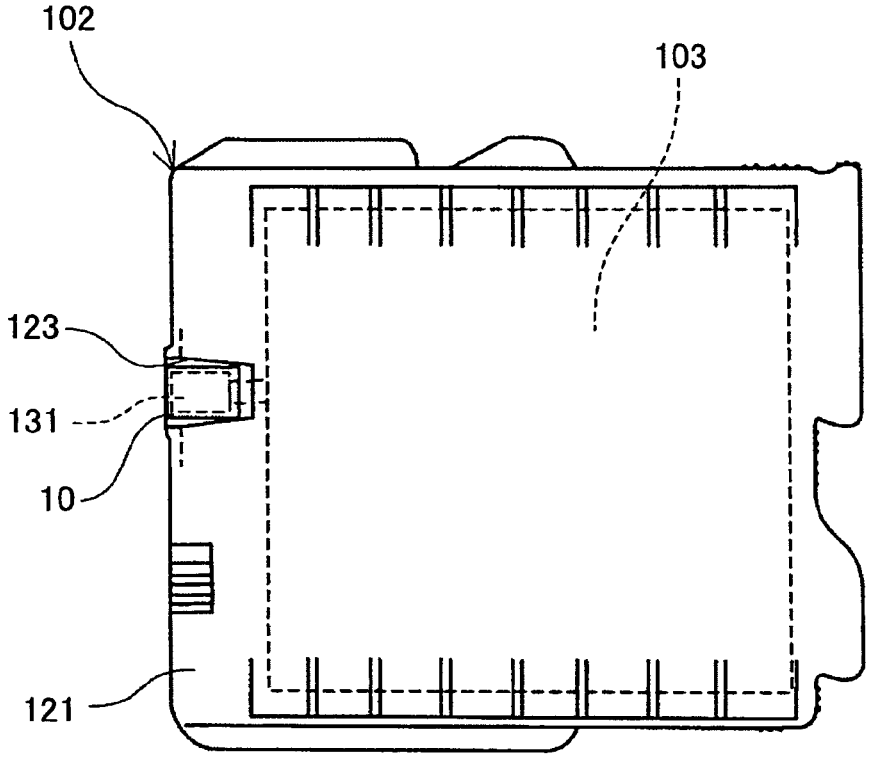
FIG. 2 shows a side view of the cartridge of the first embodiment.

FIG. 1 shows a refillable ink cartridge 1 including a cartridge case 102 in which an ink bag 103 containing ink as a recording liquid is housed. The cartridge case 102 is made up of a first case 121 and a second case 122.

The cartridge case 102 has an opening portion 123 which is located at a corresponding position to an ink supply opening portion 131 of the ink bag 103 housed within the cartridge case 102. The opening portion 123 is made up of a semicircular opening portion of the first case 121 and another semicircular opening portion of the second case 122.

When the ink cartridge 1 is mounted on an image forming apparatus, a hollow needle on the side of the apparatus is inserted into the ink supply opening portion 131 of the ink bag 103 in order to supply the ink in the ink bag 103 to the apparatus.

Figure 3:
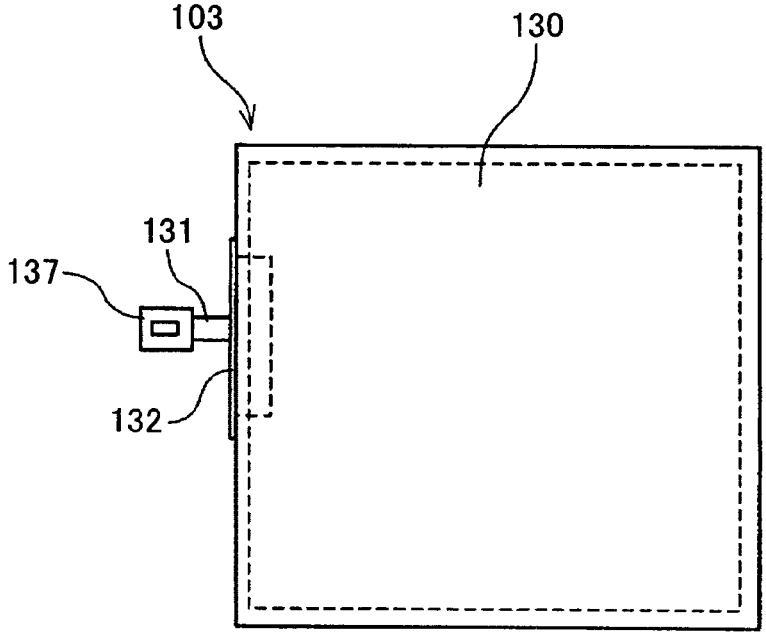
FIG. 3 shows a side view of an ink bag that is housed within the ink cartridge of the first embodiment.

The ink bag 103 housed within the ink cartridge 1 includes a flexible bag main body 130 made of an aluminum laminate film. The bag main body 130 has a substantially rectangular shape as shown in FIG. 3. On one side of the rectangle, a retaining member 132 made of resin and having an ink supply opening portion 131 is affixed (such as by welding). By having the retaining member 132 retained within the cartridge case 102 in an engaged manner, the ink bag 103 can be retained within the cartridge case 102 in a prescribed posture.

Figure 4:
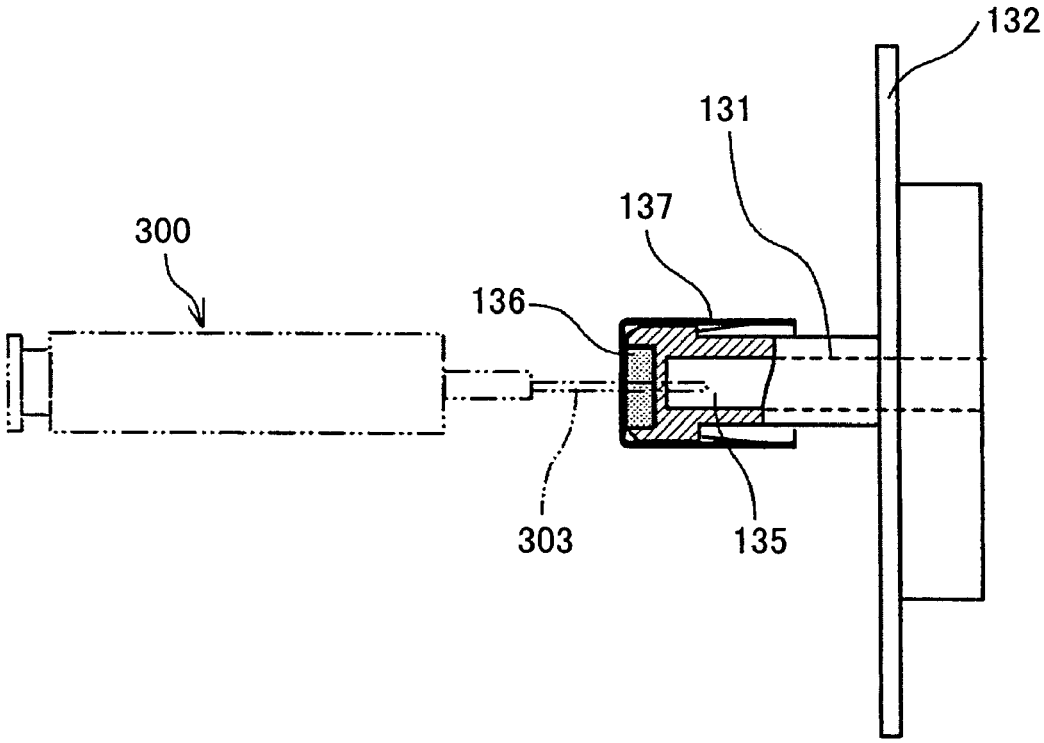
FIG. 4 is an enlarged cross-section of an ink supply opening portion of the ink bag prior to a refill.

The ink supply opening portion 131 has an ink supply opening 135, as shown in FIG. 4. At the tip of the ink supply opening 135, a sealing member 136 is fitted, which is made of a resilient material, such as silicon rubber, fluorine rubber, or butyl rubber, so that it can seal the ink supply opening 135. The sealing member 136 is held in place by a cap member 137.

Figure 5:
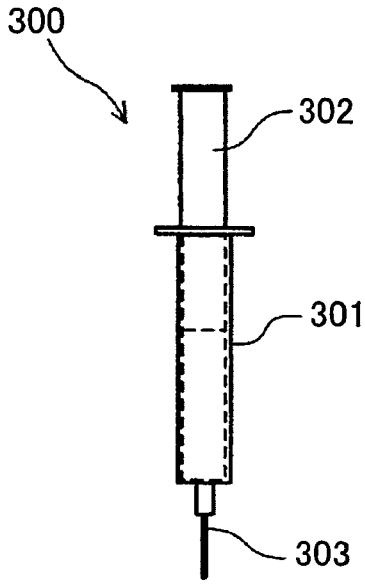
FIG. 5 shows an example of a filling device.

The refillable ink cartridge 1 may be refilled with ink via the ink supply opening portion 131, using a filling device (such as a syringe) 300 as shown in FIG. 5. The filling device 300 may consist of a cylinder 301 within which a plunger 302 is slidably disposed. The cylinder 301 may have a needle 303 at its tip, the needle 303 having a nozzle opening in fluid communication with the inside of the cylinder 301. The plunger 302 may be pushed into the cylinder 301 as it is filled with ink, whereby the ink is discharged via the opening of the needle 303. The plunger 300 may consist of a commercially available syringe.

When refilling the ink cartridge 1 of the first embodiment of the present invention using the filling device 300, the sealing member 136 of the ink supply opening portion 131 is pierced with the needle 303 as indicated by the dotted lines shown in FIG. 4, and then the filling device 300 is operated to send the ink from the cylinder 301 into the ink bag 130.

The refillable ink cartridge 1 further includes a protection member 10 disposed at the tip of the ink supply opening portion 131. The protection member 10 is configured to hermetically seal the ink supply opening portion 131 by surrounding the sealing member 136 and the cap member 137.

Figure 6:
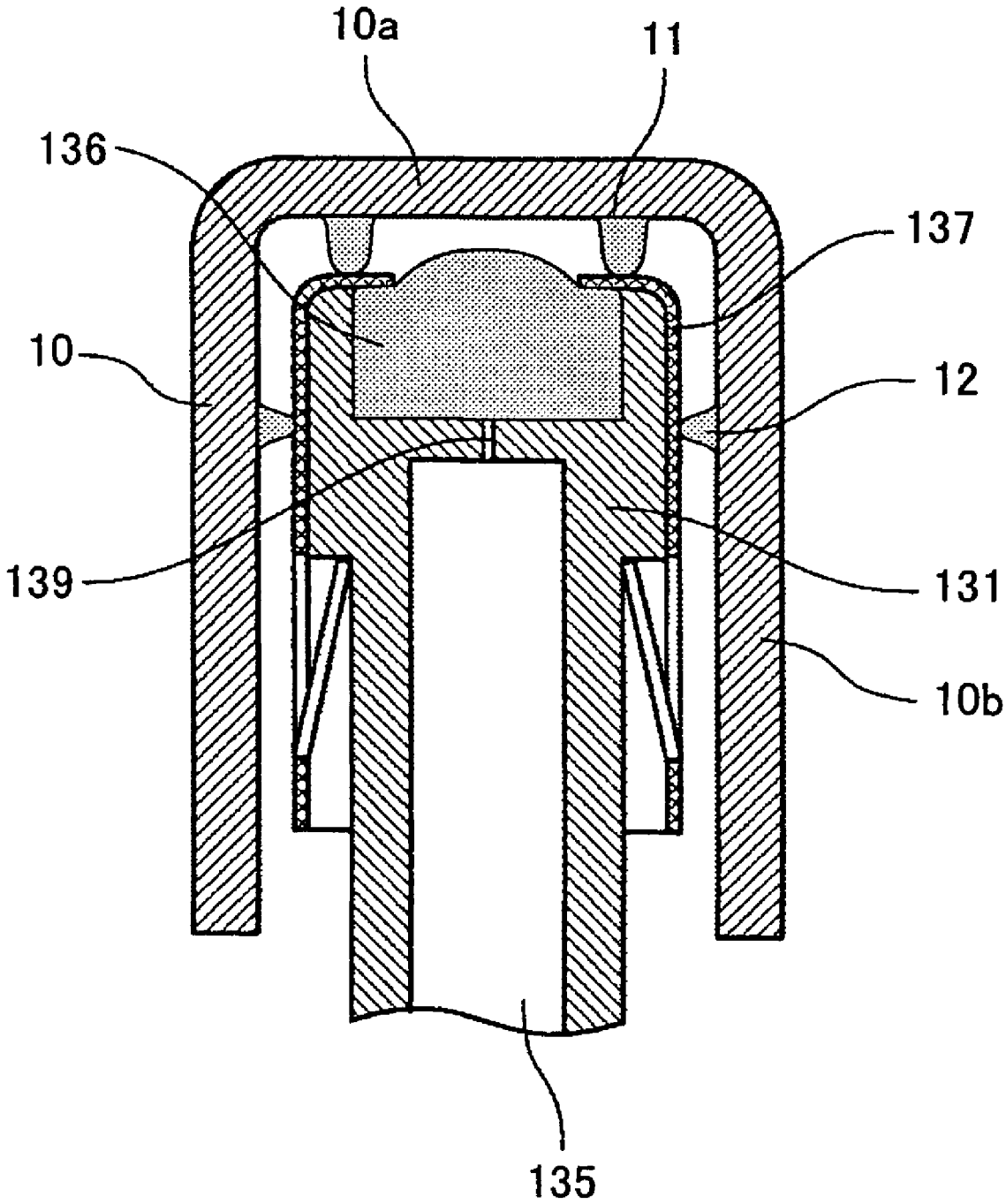
FIG. 6 is an enlarged cross-section of the ink supply opening portion of the first embodiment.

FIG. 6 shows an example of the protection member 10. It includes a cylinder member having a bottom on one end thereof, and is configured to be fitted on the periphery of the cap member 137. The protection member 10 has a ring-shaped projecting portion 11 formed on the inner surface of an opposite portion 10*a* opposite the sealing member 136. The projecting portion 11 is configured to abut against the cap portion 137 surrounding the sealing member 136. The protection member 10 includes another ring-shaped projecting portion 12 formed on the inner surface of a side portion 10*b* opposite the cap member 137. The projecting portion 12 is configured to abut against the peripheral surface of the cap portion 137 to thereby seal the ink supply opening portion 131. Preferably, these projecting portions 11 and 12 are formed of a resilient material. In another embodiment, either one of the projecting portions 11 and 12 may be provided.

When refilling the refillable ink cartridge 1 by having the sealing member 136 of the ink supply opening portion 131 pierced with the needle 303 of the refilling device 300 to send the ink to the internal ink bag 130, it may not be always possible to insert the needle 303 exactly where the needle-shaped member of the apparatus main body has pierced the sealing member 136 for initially supplying the ink to the image forming apparatus. As a result, the sealing member 136 may not rebound fully and its sealing property may decrease. Particularly, in an ink cartridge that has once been used, a pierced opening 139 is formed in the isolating wall between the ink supply opening 135 and the sealing member 136, as shown in FIG. 6. The presence of such opening increases the risk of ink leakage out of the cartridge in the event of a decrease in resilience of the sealing member 136.

This problem is overcome by the protection member 10 mounted (fitted) outside the sealing member 136 of the ink supply opening portion 131, providing an additional sealing of the ink supply opening portion 131. When the sealing member 136 loses some of its resilience and comes to have a reduced sealing property, any of the ink that may leak through the sealing member 136 is prevented from further leakage outside by the projecting portions 11 and 12 of the protection member 10.

Figure 7:
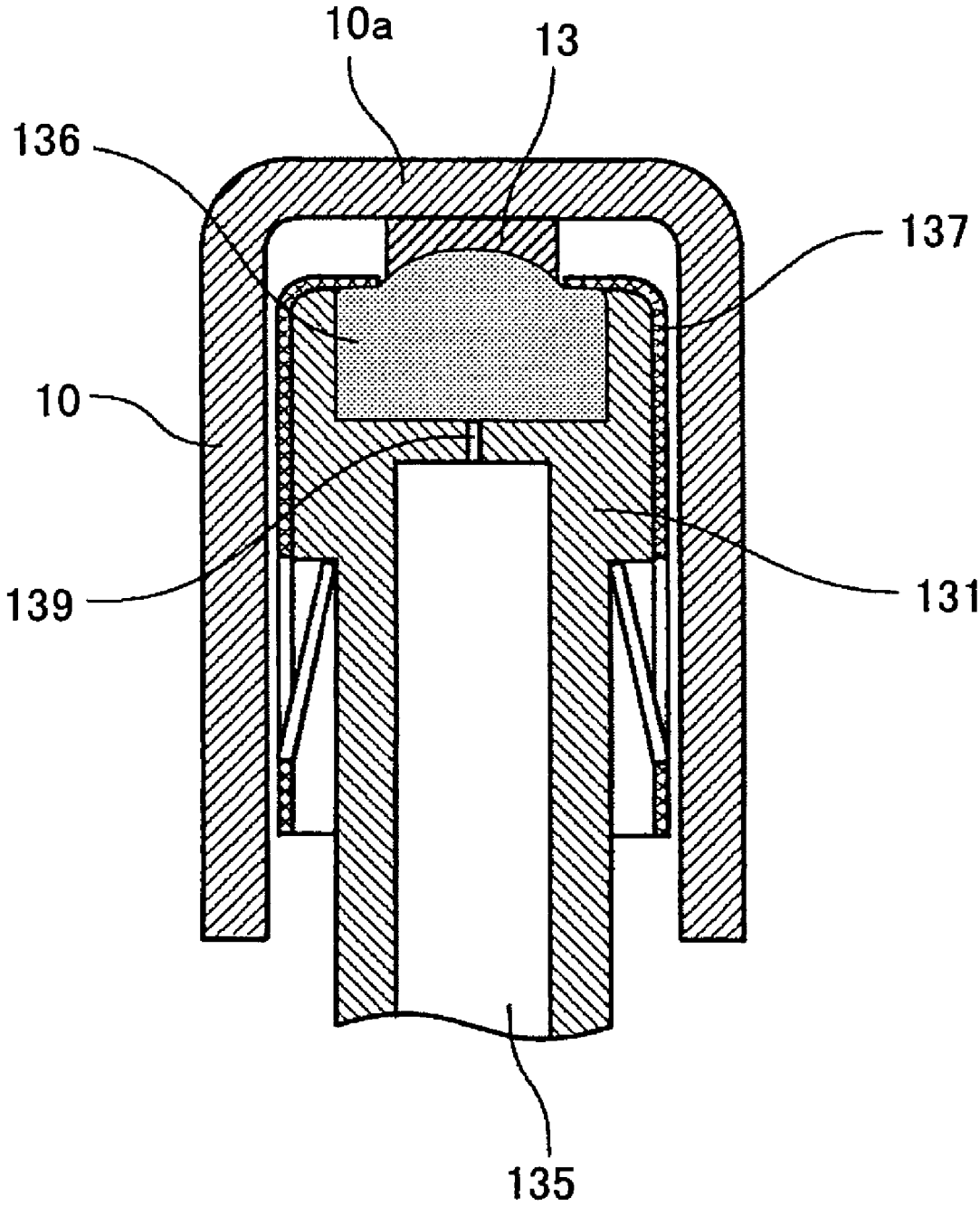
FIG. 7 is an enlarged cross-section of the ink supply opening portion for describing a protection member according to a second embodiment of the invention.

In the following, a protection member according to a second embodiment of the present invention is described with reference to FIG. 7. FIG. 7 shows an enlarged cross-section of an ink supply opening portion of a refillable ink cartridge.

A protection member 10 of the present embodiment has a tight-contact portion 13 disposed on the internal surface of an opposite portion 10*a* opposite the sealing member 136 of the ink supply opening portion 131. The tight-contact portion 13 is tightly contacted with the cap portion 137 surrounding the sealing member 136, thus hermetically sealing the sealing member 136.

Thus, by mounting the protection member 10 outside the sealing member 136 of the ink supply opening portion 131 of the refillable ink cartridge 1, the sealing member 136 is hermetically sealed by the tight-contact portion 13 on the outside of the sealing member 136. As a result, leakage of ink to the outside through the sealing member 136 can be prevented even if the sealing member 136 loses its resilience and its sealing property drops to such an extent that the ink can penetrate the sealing member 136.

Figure 8:
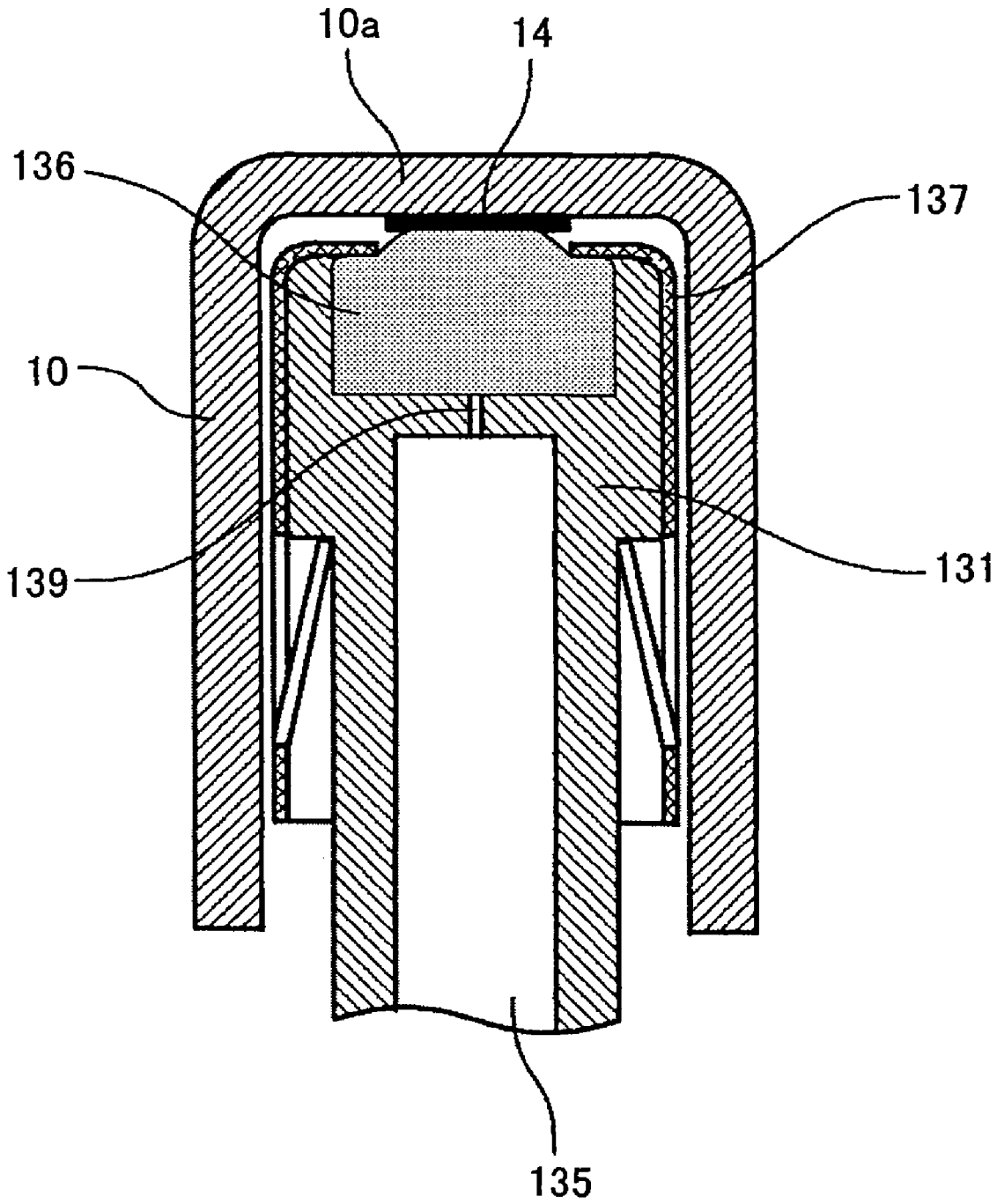
FIG. 8 is an enlarged cross-section of the ink supply opening portion for describing a protection member according to a third embodiment of the invention.

In the following, a protection member according to a third embodiment of the present invention is described with reference to FIG. 8. FIG. 8 shows an enlarged cross-section of the ink supply opening portion of a refillable ink cartridge.

In this embodiment, the protection member 10 has an adhesive portion 14 disposed on the inner surface of an opposite portion 10*a* opposite the sealing member 136 of the ink supply opening portion 131. The adhesive portion 14 adheres to the cap portion 137 surrounding the sealing member 136, thereby hermetically sealing the sealing portion 136.

By thus attaching the protection member 10 on the outside of the sealing member 136 of the ink supply opening portion 131 of the refillable ink cartridge 1, the outer surface of the sealing member 136 can be hermetically sealed by the adhesive portion 14. As a result, even if the sealing member 136 loses some of its resilience and its sealing property drops to such an extent that the ink can penetrate the sealing member 136, further leakage of the ink outside the sealing member 136 is prevented.

Figure 9:
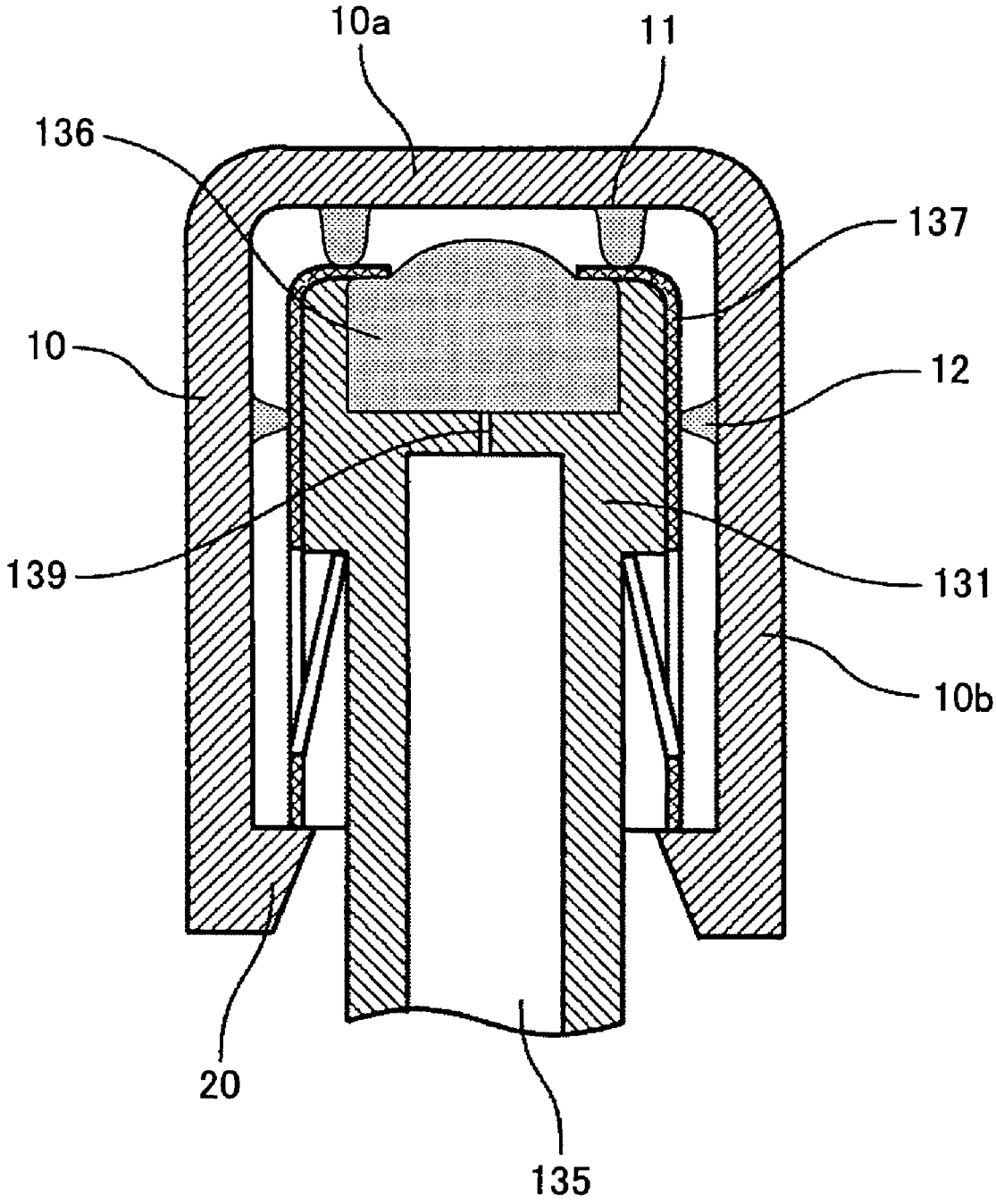
FIG. 9 is an enlarged cross-section of the ink supply opening portion for describing a protection member according to a fourth embodiment of the invention.

In the following, a protection member according to a fourth embodiment of the invention is described with reference to FIG. 9, showing an enlarged cross-section of the ink supply opening portion of a refillable ink cartridge.

The protection member 10 of the present embodiment differs from that of the first embodiment in that a locking portion 20 is formed that is configured to lock on an end of the cap member 137. When the protection member 10 is fitted on the cap member 137 of the ink supply opening portion 131, the locking portion 20 is locked such that the projecting portion 11 is compressed.

Thus, the locking member 20 helps to retain the protection member 10 on the ink supply opening portion more reliably. Because the sealing portion, i.e., the projecting portions 11 and 12, is compressed as the protection member is fitted, the ink supply opening portion 131 can be more reliably hermetically sealed by the sealing portion.

Figure 10:
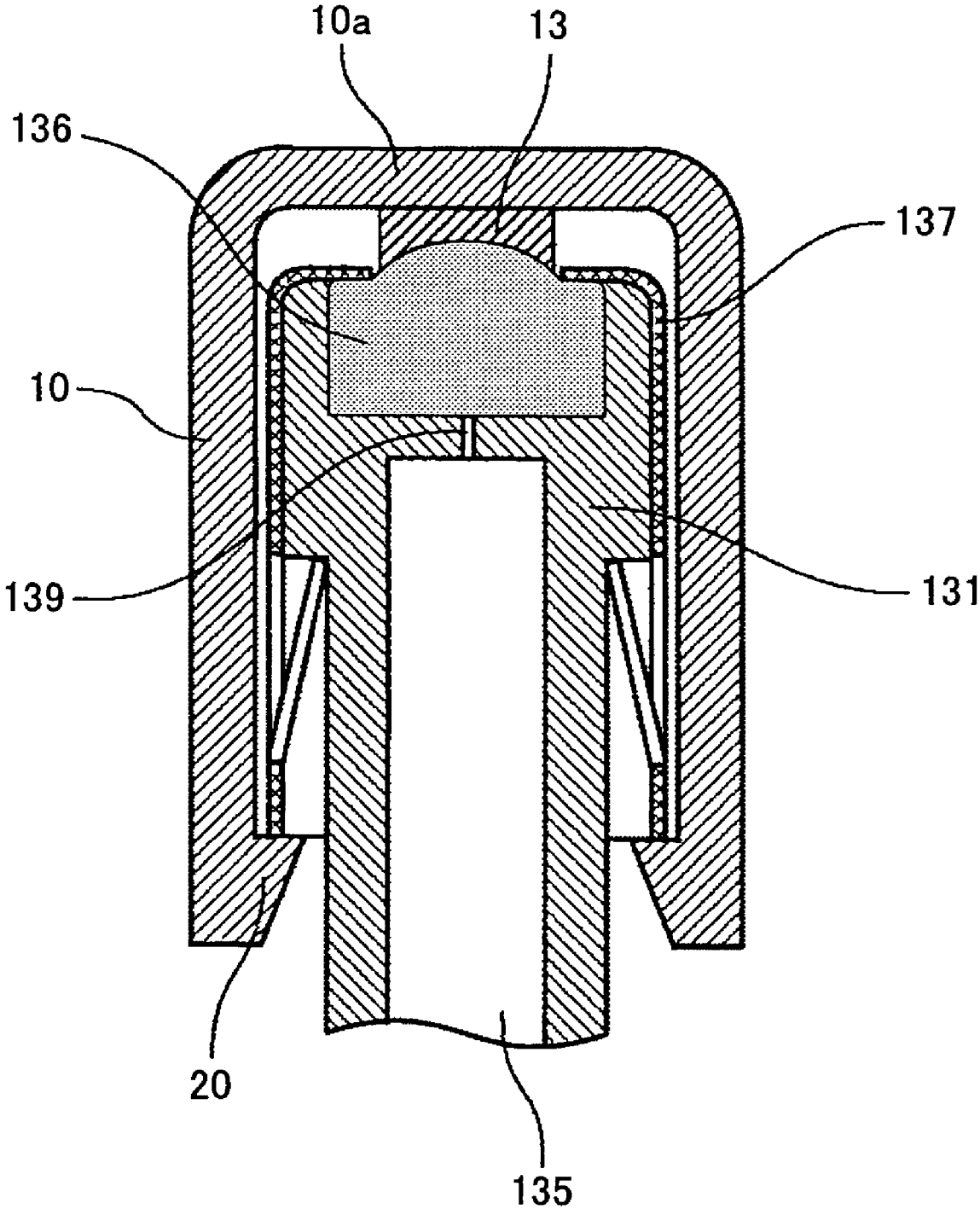
FIG. 10 shows the ink supply opening portion of a protection member according to a fifth embodiment of the invention.

In the following, a protection member according to a fifth embodiment of the invention is described with reference to FIG. 10, showing an enlarged cross-section of the ink supply opening portion of a refillable ink cartridge.

The protection member 10 of the present embodiment differs from that of the second embodiment in that a locking portion 20 is formed that is configured to be locked on an end of the cap member 137. When the protection member 10 is fitted on the cap member 137 of the ink supply opening portion 131, the locking portion 20 is locked while the sealing member 136 is compressed. As a result, the similar effect to that of the fourth embodiment can be obtained.

Figure 11:
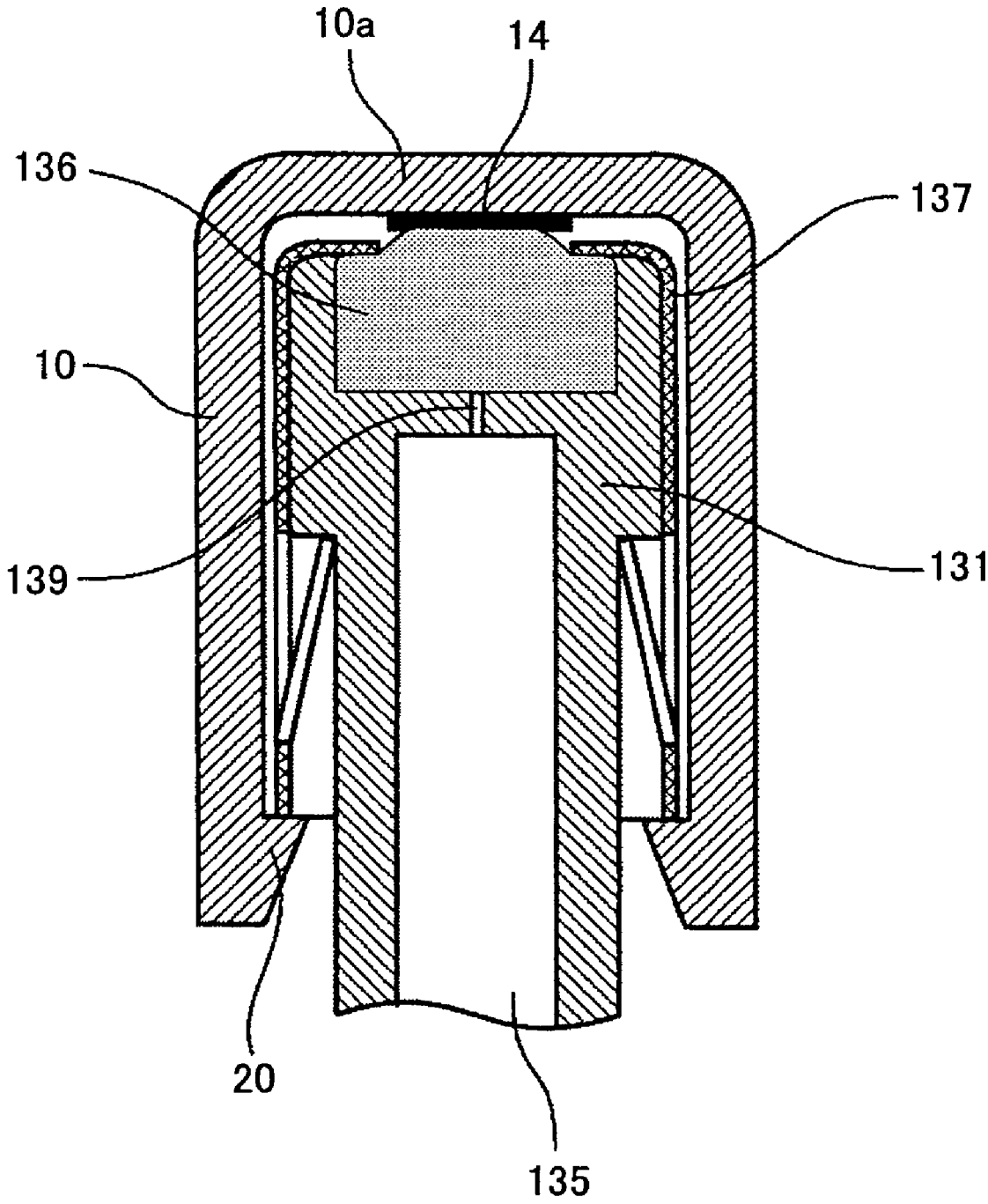
FIG. 11 is an enlarged cross-section of an ink supply opening portion for describing a protection member according to a sixth embodiment of the invention.

In the following, a protection member according to a sixth embodiment of the invention is described with reference to FIG. 11, showing an enlarged cross-section of the ink supply opening portion of a refillable ink cartridge.

The protection member 10 of the present embodiment differs from that of the third embodiment in that a locking portion 20 is formed that is configured to be locked on an end of the cap member 137 of the protection member 10. When the protection member 10 is fitted on the cap member 137 of the ink supply opening portion 131, and the locking portion 20 is locked on the end of the cap member 137, the adhesive portion 14 is pressed against the sealing member 136. Thus, the similar effect to that of the fourth embodiment can be obtained.

Although the invention has been described with reference to particular examples, it will be appreciated by those skilled in the art that various modifications and changes can be made within the scope of the invention.

The present application is based on the Japanese Priority Application No. 2007-160705 filed Jun. 18, 2007, the entire contents of which are hereby incorporated by reference.

The invention claimed is:

1. A refillable ink cartridge containing ink that is supplied to a liquid discharge device that discharges a droplet of the ink, the refillable ink cartridge comprising:

an ink supply opening portion including an ink supply opening;

an elastically deformable sealing member configured to hermetically seal the ink supply opening, wherein the sealing member is configured to be penetrated by a needle-shaped member in order to allow the refillable ink cartridge to be refilled with ink via the ink supply opening portion;

a cap member configured to hold the sealing member in place; and a protection member including a cylinder member being configured to be fitted on a periphery of the cap member, the protection member including a sealing portion disposed on an inner surface of the protection member and being configured to hermetically seal the ink supply opening portion outside the sealing member.

2. The refillable ink cartridge according to claim 1, wherein the sealing portion of the protection member includes a projecting portion formed on an inner side of the protection member, the projecting portion contacting an outer surface of the ink supply opening portion to hermetically seal the ink supply opening portion.

3. The refillable ink cartridge according to claim 1, wherein the sealing portion of the protection member includes a tight-contact portion that is tightly contacted with an outer surface of the sealing member of the ink supply opening portion.

4. The refillable ink cartridge according to claim 1, wherein the sealing portion of the protection member includes an adhesive portion that adheres to an outer surface of the sealing member of the ink supply opening portion.

5. The refillable ink cartridge according to claim 1, wherein the protection member includes a locking portion configured to be locked on the ink supply opening portion.

6. The refillable ink cartridge according to claim 1, wherein the protection member is fitted such that the sealing portion is compressed.

7. A protection member for sealing a refillable ink cartridge containing ink that is supplied to a liquid discharge device that discharges a droplet of the ink, the refillable ink cartridge comprising:

an ink supply opening portion including an ink supply opening;

an elastically deformable sealing member configured to hermetically seal the ink supply opening; and a cap member configured to hold the sealing member in place;

wherein the sealing member is configured to be penetrated by a needle-shaped member in order to allow the refillable ink cartridge to be refilled with ink via the ink supply opening portion; and wherein the protection member is configured to be fitted on a periphery of the cap member, and the protection member includes a sealing portion configured to be disposed outside the sealing member of the ink supply opening portion to hermetically seal the ink supply opening portion.

8. The refillable ink cartridge according to claim 1, wherein portions of the cap member contact portions of the sealing member to hold the sealing member in place, and the sealing portion of the protection member contacts said portions of the cap member to hermetically seal the ink supply opening portion.

9. The refillable ink cartridge according to claim 1, wherein the cap member includes portions that contact the sealing member to hold the sealing member in place, and the cap member includes a gap portion that does not contact the sealing member, the gap portion permitting the sealing member to be penetrated by the needle-shaped member.

* * * * *